US011771254B2

(12) United States Patent
Cobb et al.

(10) Patent No.: US 11,771,254 B2
(45) Date of Patent: Oct. 3, 2023

(54) MAIL SLOT INSERT WITH FOAM ATTACHMENT

(71) Applicant: BOTA, Inc., Denver, CO (US)

(72) Inventors: Dalanda Cobb, Denver, CO (US); Jon C. Voigtmann, Denver, CO (US)

(73) Assignee: BOTA, Inc., Denver, CO (US)

( * ) Notice: Subject to any disclaimer, the term of this patent is extended or adjusted under 35 U.S.C. 154(b) by 8 days.

(21) Appl. No.: 17/485,769

(22) Filed: Sep. 27, 2021

(65) Prior Publication Data

US 2022/0095823 A1 Mar. 31, 2022

Related U.S. Application Data

(60) Provisional application No. 63/084,740, filed on Sep. 29, 2020.

(51) Int. Cl.
*A47G 29/126* (2006.01)

(52) U.S. Cl.
CPC ..... *A47G 29/126* (2013.01)

(58) Field of Classification Search
CPC .. A47G 29/126; A47G 29/122; A47G 29/124; A47G 29/1245
USPC ..... 232/44, 45
See application file for complete search history.

(56) References Cited

U.S. PATENT DOCUMENTS 746,906 A * 12/1903 Wimer ..... A47G 29/126 232/45
1,540,482 A 6/1925 Landaal
1,548,249 A 8/1925 Binns
1,578,357 A 3/1926 Parkins
1,857,141 A 5/1932 Corley
2,078,744 A 4/1937 Tursky
2,138,124 A 11/1938 Schnell
2,250,263 A 7/1941 Horwitt
2,437,319 A 3/1948 Gable et al.
2,442,967 A 6/1948 Barasch et al.
2,595,535 A * 5/1952 Nowakowski ..... A47G 29/126 232/45
2,790,259 A 4/1957 Havens
2,866,286 A 12/1958 Hartman
3,451,153 A 6/1969 Dohanyos
3,465,461 A 9/1969 Price et al.
3,567,112 A 3/1971 Wittekind
4,545,522 A 10/1985 Kerzner
5,448,841 A 9/1995 Hampton
5,579,596 A 12/1996 Kovacs et al.
(Continued)

FOREIGN PATENT DOCUMENTS

DE 102010030978 A1 1/2012
GB 854742 A 11/1960
(Continued)

*Primary Examiner* — William L Miller
(74) *Attorney, Agent, or Firm* — THE WEBB LAW FIRM

(57) ABSTRACT

An adjustable mail slot insert may include two top members connected to one another and two bottom members connected to one another. Each bottom member may include a side leg and a bottom leg. Each top member may include a side leg and a top leg. One top member may be connected to one bottom frame member and another top frame member may be connected to another bottom frame member. The insert may be adjustable in a horizontal direction and a vertical direction through movement of the members relative to one another.

17 Claims, 11 Drawing Sheets

(56) References Cited

U.S. PATENT DOCUMENTS

| | | | | |
|---|---|---|---|---|
| 6,377,320 | B1 | 4/2002 | Ananian et al. | |
| 6,898,886 | B1 | 5/2005 | Montecalvo | |
| 6,976,620 | B2 * | 12/2005 | Swider | A47G 29/22 232/52 |
| 7,296,732 | B2 * | 11/2007 | Roddy | A47G 29/126 232/19 |
| 7,451,912 | B1 | 11/2008 | Taube, II | |
| 8,261,965 | B2 * | 9/2012 | Cyphers | E05C 3/042 109/66 |
| 9,839,314 | B2 | 12/2017 | De La Nuez et al. | |
| 10,172,492 | B2 * | 1/2019 | Cobb | A47G 29/126 |
| 2004/0128894 | A1 | 7/2004 | Sachs-Lavery | |
| 2006/0022028 | A1 | 2/2006 | Thomas | |
| 2007/0028543 | A1 | 2/2007 | Lachance | |
| 2008/0209787 | A1 | 9/2008 | Alcov | |
| 2009/0193692 | A1 | 8/2009 | Lipczynski | |
| 2010/0083581 | A1 | 4/2010 | Mattice | |
| 2015/0282359 | A1 | 10/2015 | Raccah | |
| 2016/0206125 | A1 | 7/2016 | Cobb | |
| 2022/0095822 | A1 * | 3/2022 | Tartal | A47G 29/122 |

FOREIGN PATENT DOCUMENTS

| | | | |
|---|---|---|---|
| GB | 2038621 | A | 7/1980 |
| GB | 2094141 | A | 9/1982 |
| GB | 2291680 | A | 1/1996 |
| GB | 2426998 | A | 12/2006 |
| GB | 2502809 | A | 12/2013 |
| GB | 2515065 | A | 12/2014 |
| GB | 2525707 | A | 11/2015 |

* cited by examiner

MAIL SLOT INSERT WITH FOAM ATTACHMENT

CROSS REFERENCE TO RELATED APPLICATIONS

This application claims the benefit of U.S. Provisional Patent Application No. 63/084,740, filed on Sep. 29, 2020, the disclosure of which is incorporated by reference in its entirety.

BACKGROUND OF THE INVENTION

Field of the Invention

This disclosure generally relates to inserts for mail slots, and more particularly, to an adjustable insert for a door mail slot with foam attachment.

Description of Related Art

Inserts for mail slots are well known in the art and have been used in many different types of environments, such as doors, windows, or walls. The inserts are typically provided in a slot defined or cut-out of the particular object, such as a door. The insert is often positioned in the cut-out via a friction fit, adhesive, or fastener. The insert is provided in a tight, snug fitting within the door such that the insert is provided flush against the door such that the side surfaces of the mail slots are flush with the door. However, there is an intentional gap between the front of the mail slots and the front of the door. Hence, the inserts will often also include a door or hinged member that covers either the front or rear opening of the insert to protect against cold or hot air, odors, small particles, or similar objects from entering the building via the mail slot insert.

It is common practice to provide mail slots that are manufactured in pre-defined dimensions according to the dimensions of the mail slots typically cut out in doors. Presently, however, doors are increasingly provided with a variety of dimensions for the mail slot. Due to aesthetic and functional purposes, different doors include different sized mail slots. Therefore, in the event an individual purchases a new door in his/her house or office building, the individual is most likely required to obtain a new mail slot insert for the new door according to the new dimensions of the mail slot. Problems arise, however, when an individual attempts to use a smaller mail slot insert that does not fit into the mail slot cut out of the door. In this situation, air gaps are created between the outer edges of the mail slot insert and the mail slot itself. Cold and/or hot air is then permitted to flow through the air gaps into the building. Eventually, the individual may need to provide insulation in the mail slot to prevent the passage of air into the building or will need to buy a new mail slot insert that has the same dimensions as the new mail slot.

SUMMARY OF THE INVENTION

In view of the foregoing, a need exists for a mail slot insert that can be used in any door regardless of the dimensions of the mail slot that is cut out of the door. A further need exists for a mail slot insert that can be adjusted to fit into any mail slot. A further need exists for a mail slot that can provide an air tight passage that prevents hot and/or cold air from flowing into the building. A further need exists for easy and simple installation of the mail slot inserts regardless of the door types and sizes, as well as any type and size of existing mail slots and covers. A further need exists for preventing bugs or critters from entering a building via the mail slots.

In one aspect, an adjustable mail slot insert is compatible with any types of door. For example, the mail slot insert is compatible with typical doors with 1.5" and 1.75" thickness that are not hollow. The adjustable mail slot insert is compatible with most existing holes, or mail slots, as well as their existing flaps on the doors. For instance, the adjustable mail slot insert may be placed behind the existing flap towards the indoors as to allow rotation of the existing flap in conjunction with the mail slot insert. The adjustable mail slot insert allows various configuration of sizes to fit a wide range of mail slots.

In one aspect, an adjustable mail slot insert may include two top frame members connected to one another and two bottom frame members connected to one another. Each bottom frame member may include a side leg and a bottom leg. Each top frame member may include a side leg and a top leg. One top frame member may be connected to one bottom frame member and another top frame member may be connected to another bottom frame member. The insert may be adjustable in a horizontal direction and a vertical direction through movement of the frame members relative to one another.

A top adjusting member may extend between the top legs of the top frame members. A bottom adjusting member may extend between the bottom legs of the bottom frame members. A right side adjusting member may extend between the right side legs of the top frame member and the bottom frame member. A left side adjusting member may extend between the left side legs of the top frame member and the bottom frame member. The side leg of one of the top frame members may include a first protrusion extending therefrom. The side leg of the other top frame member may define a first channel therein. The side leg of one of the bottom frame members may include a second protrusion extending therefrom. The side leg of the other bottom frame member may define a second channel therein. The first protrusion may be inserted into the second channel. The second protrusion may be inserted into the first channel. The top leg of one of the top frame members may define a first channel therein. The top leg of the other top frame member may include a first protrusion extending therefrom. The bottom leg of one of the bottom frame members may include a second protrusion extending therefrom. The bottom leg of the other bottom frame member may define a second channel therein. The first protrusion may be inserted into the first channel. The second protrusion may be inserted into the second channel.

At least one flap attachment may be positioned on at least one of the top frame members and the bottom frame members. The at least one flap attachment may be positioned across the top frame members or the bottom frame members. A flap attachment may be positioned on each top frame member and each bottom frame member. The flap attachments may be offset relative to one another when positioned in the adjustable mail slot insert. At least one flap holder may hold the at least one flap attachment on at least one of the top frame members and the bottom frame members. The at least one flap holder may define a channel to receive and retain the at least one flap attachment within the at least one flap holder. The at least one flap attachment may be removably positioned on at least one of the top frame members and the bottom frame members. The flap may further comprise insulation members, such as a foam. The flap may be deformable such that a deformed state of the flap creates an opening in the insert. The flap may comprise weights that help the flap return to its closed position. The insert may further comprise magnets that interact with the flap to aid the flap return to its closed position after it is deformed. The adjustable mail slot insert may have a substantially rectangular cross-section. The flap may further comprise caps that create air pockets within the flap to serve as an additional insulation measure. The height and width of the adjustable mail slot insert may be adjustable. The height of one side of the insert may differ from the height of the other side of the insert. The top frame members and the bottom frame members may be substantially L-shaped.

In another aspect, a method of adjusting a mail slot insert may include a) providing an adjustable mail slot insert, including a frame having a first frame member, a second frame member, a third frame member, and a fourth frame member; and, either b) moving the first frame member and the third frame member of the frame relative to one another to adjust the height of the frame; or c) moving the second frame member and the fourth frame member of the frame relative to one another to adjust the width of the frame. The adjustable mail slot insert may include at least one adjusting member positioned on each portion of the frame.

Accordingly, and generally, an adjustable mail slot insert and a method of adjusting the mail slot insert are provided to address and/or overcome some or all of the deficiencies or drawbacks associated with existing mail slot inserts.

Further non-limiting embodiments or aspects will be set forth in the following numbered clauses:

Clause 1: An adjustable mail slot insert, comprising: two upper members, each upper member having a side leg and a top leg; two lower members, each lower member having a side leg and a top leg; and a flap, wherein the flap is connected to the two upper members, wherein one top member is operatively connected to one bottom member and the other top member is operatively connected to the other bottom member, wherein the flap further comprises a resistant deformable foam material, and wherein the insert is adjustable in a horizontal direction and a vertical direction through movement of the upper and lower members relative to one another.

Clause 2: The adjustable mail slot insert of clause 1, further comprising an adjusting member, wherein the adjusting member is received within channels of the two lower members.

Clause 3: The adjustable mail slot insert of any of clauses 1 or 2, wherein the adjusting member further comprises an anti-contraction lock and a resistance member, wherein the resistance member allows the anti-contraction lock to protrude a groove of the plurality of grooves of one of the two lower members.

Clause 4: The adjustable mail slot insert of any of clauses 1-3, wherein the anti-contraction lock is tapered.

Clause 5: The adjustable mail slot insert of any of clauses 1-4, wherein the flap further comprises insulating members and a back weight.

Clause 6: The adjustable mail slot insert of any of clauses 1-5, wherein the flap is deformable.

Clause 7: The adjustable mail slot insert of any of clauses 1-6, wherein the flap further comprises metal rods.

Clause 8: The adjustable mail slot insert of any of clauses 1-7, wherein the flap further comprises at least one cap, wherein the cap covers a side surface of the flap, wherein the cap creates an air pocket between the cap and the flap.

Clause 9: The adjustable mail slot insert of any of clauses 1-8, wherein the flap further comprises an extension flap.

Clause 10: The adjustable mail slot insert of any of clauses 1-9, wherein the lower members further comprise magnets.

Clause 11: The adjustable mail slot insert of any of clauses 1-10, wherein the upper members further comprise a plurality of grooves and the lower members further comprise anti-contraction locks and resistance members, and wherein the resistance members allow each anti-contraction lock to protrude a groove of the plurality of grooves of the respective upper member.

Clause 12: The adjustable mail slot insert of any of clauses 1-11, wherein the anti-contraction locks are tapered.

Clause 13: The adjustable mail slot insert of any of clauses 1-12, wherein the upper members and the lower members are substantially L-shaped.

Clause 14: A method of adjusting a mail slot insert, comprising the steps of: providing an adjustable mail slot insert comprising: two upper members; two lower members; a flap; and an adjusting member; and, either a) moving the lower members and the adjusting member relative to one another to adjust the width of the insert; or b) moving the lower members and the upper members relative to one another to adjust the height of the insert.

Clause 15: An adjustable mail slot insert comprising: two left members, each left member having a side leg and a top leg; two right members, each right member having a side leg and a top leg; and at least one anti-contraction lock and at least one resistance member, wherein the anti-contraction locks lock the two left members and the two right members in place, and wherein the anti-contraction lock and the resistance member lock one of the two left members and one of the two right members in place.

Clause 16: The adjustable mail slot insert of clause 15, wherein one of the two left members further comprises a plurality of grooves and the other left member is configured to receive the anti-contraction lock and the resistance member.

Clause 17: The adjustable mail slot insert of any of clauses 15 or 16, wherein the anti-contraction locks are tapered and resisted by the resistance members, wherein the anti-contraction lock is configured to fit into a groove of the plurality of grooves, and wherein the anti-contraction lock is pushed into the groove by the resistance member.

Clause 18: The adjustable mail slot insert of any of clauses 15-17, wherein the tapered anti-contraction lock limits the movement of the left members and right members in one direction.

Clause 19: The adjustable mail slot insert of any of clauses 15-18, further comprising a adjusting member, the adjusting member having an anti-contraction lock and a resistance member, the adjusting member configured to be received by one of the two left members and one of the two right members, wherein one of the one of the two left members and one of the two right members further comprises a plurality of grooves.

Clause 20: The adjustable mail slot insert of any of clauses 15-19, wherein the anti-contraction lock is tapered and resisted by the resistance member, wherein the anti-contraction lock is configured to fit into a groove of the plurality of grooves, and wherein the anti-contraction lock is pushed into the groove by the resistance member.

These and other features and characteristics of the present disclosure, as well as the methods of operation and functions of the related elements of structures and the combination of parts will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

DESCRIPTION OF THE INVENTION

Figure 1:
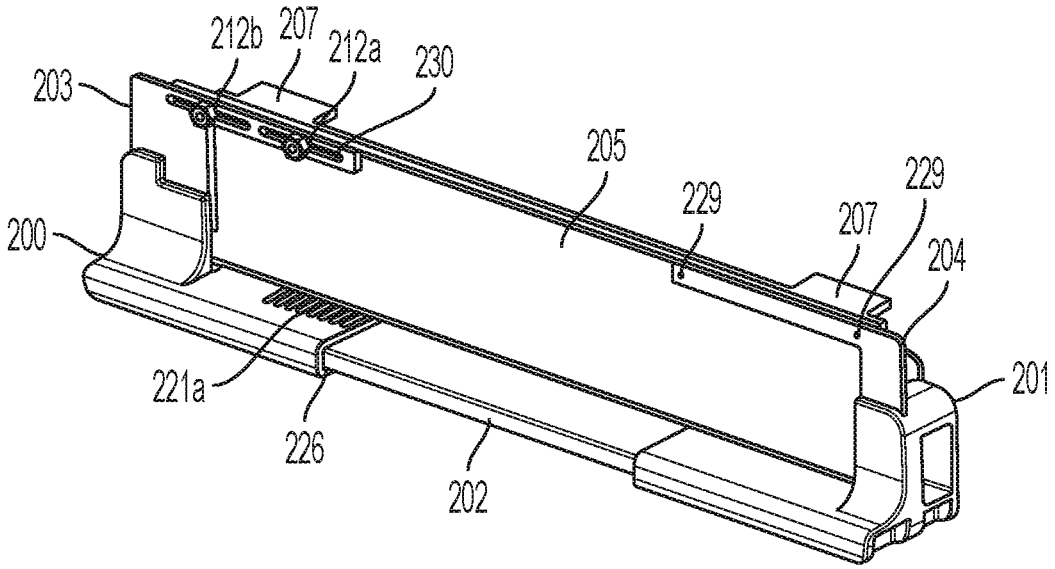
FIG. 1 is a front perspective view of an adjustable mail slot insert in accordance with one aspect of this disclosure.

For purposes of the description hereinafter, the terms "upper", "lower", "right", "left", "vertical", "horizontal", "top", "bottom", "lateral", "longitudinal", and derivatives thereof shall relate to the invention as it is oriented in the drawings. However, it is to be understood that the invention may assume alternative variations and step sequences, except where expressly specified to the contrary. It is also to be understood that the specific devices and processes illustrated in the attached drawings, and described in the following specification, are simply exemplary aspects of the invention. Hence, specific dimensions and other physical characteristics related to the aspects disclosed herein are not to be considered as limiting.

The present disclosure is directed to, in general, a mail slot insert and, in particular, to an adjustable mail slot insert for a door. Certain preferred and non-limiting aspects of the components of the adjustable mail slot insert are illustrated in FIGS. 1-17.

Figure 2:
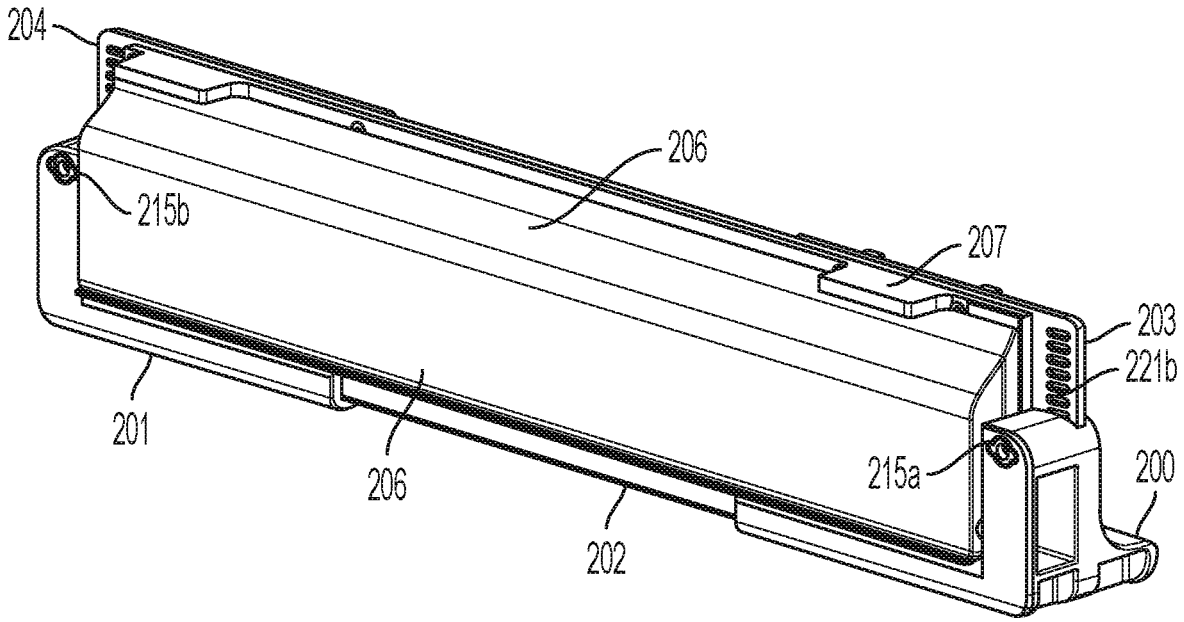
FIG. 2 is a back perspective view of the adjustable mail slot insert of FIG. 1.
Figure 3:
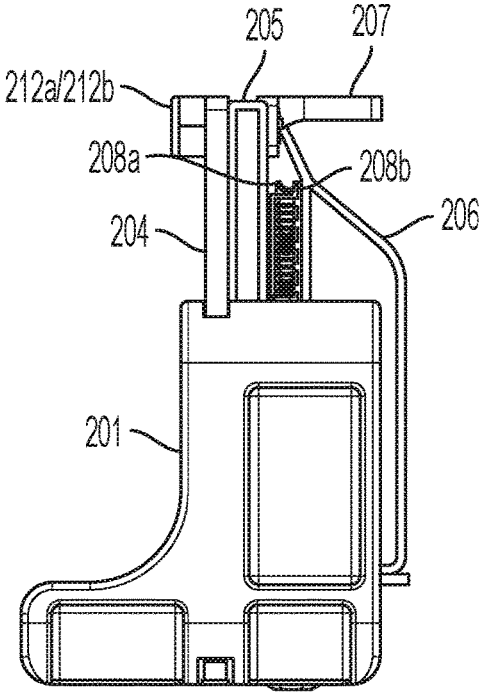
FIG. 3 is a side view of the adjustable mail slot insert of FIG. 1.
Figure 8:
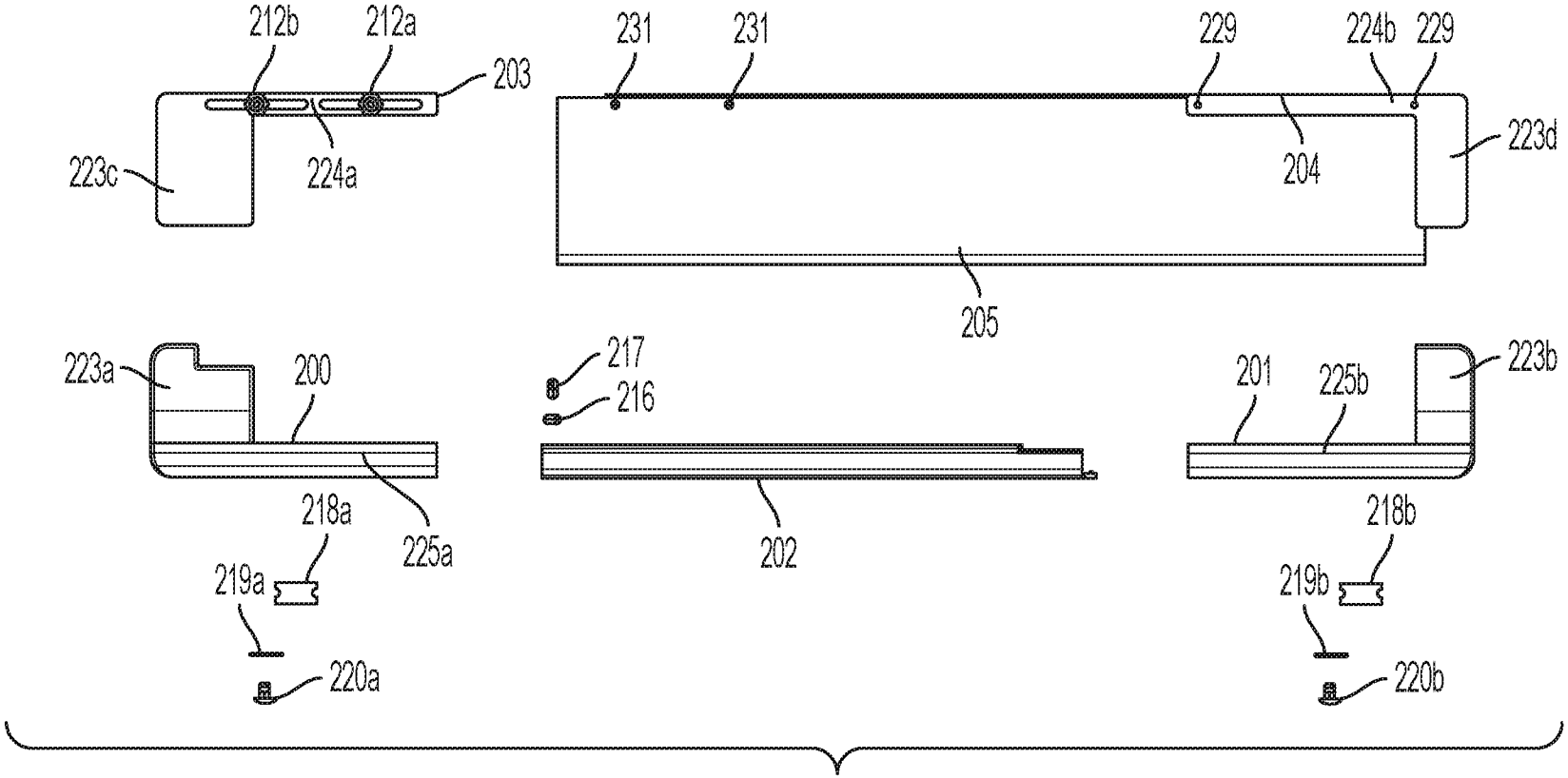
FIG. 8 is an exploded view of the front of the adjustable mail slot of FIG. 1.

With reference to FIGS. 1-3, an adjustable mail slot insert 1 (herein after referred to as "insert 1") is shown. The insert 1 is desirably adapted for use in a door of a residential home, office building, or post office. However, it is to be understood that the insert 1 may be used in various other environments, such as a window or an opening defined in a wall. The insert 2 is formed from four separate members: lower left member 200, lower right member 201, upper left member 203, and upper right member 204. In one aspect, the insert 1 may be made of any material, to include but not limited to stainless metals such as steel or aluminum and/or plastic materials such as nylon or EPDM foam. The insert 1 may further be coated with weather resistant spray coating or layer. In one aspect, the four separate members may be substantially "L-shaped", so as to form a substantially rectangular insert 1. It is also contemplated that the separate members may form a substantially square insert. Each frame member may also include a side leg 223*a-d* respectively, as shown in FIG. 8. The upper left member 203 and the upper right member 204 may also include a top leg 224*a*, 224*b* respectively as shown in FIG. 8. In one aspect, the side legs 223*c*, 223*d* may be shorter than top legs 224*a*, 224*b*. The lower left member 200 and the lower right member 201 may also include bottom legs 225*a*, 225*b* respectively, as shown in FIG. 8. In one aspect the side legs 223*a*, 223*b* may be shorter than the bottom legs 225*a*, 225*b*. In a further non-limiting embodiment, the corners, or the four members 200, 201, 203, 204, of the insert 1 may be rounded.

Figure 9:
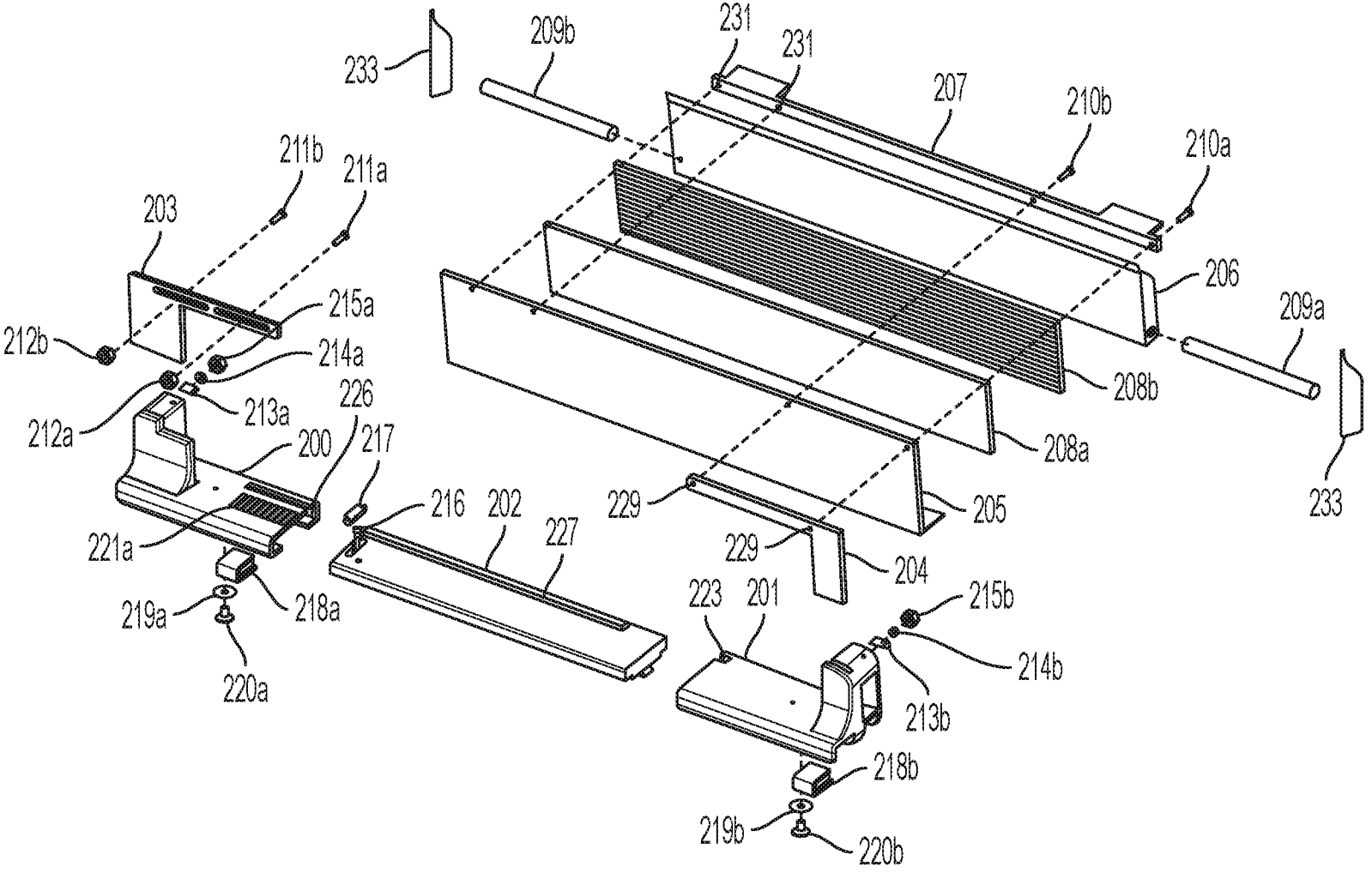
FIG. 9 is an exploded view of the front perspective view of the adjustable mail slot insert of FIG. 1.

The lower left member 200 and the lower right member 201 may further comprise a channel 226. The channels 226 of the two members are configured to receive the adjusting member 202. In one aspect, the lower left member 200 is slidable within the channel 226. In a further aspect, the two lower members hold the adjusting member 202 in place. With reference to FIG. 9, the adjusting member 202 may further comprise a protrusion 227 that may fit in an indent 223 of the lower right member 201, such that the adjusting member 202 and the lower right member 201 may lock when the adjusting member 202 slides into the channel 226 of the lower right member 201. In another aspect, the indent 223 may be present on the lower left member 200 such that the adjusting member 202 and the lower left member 200 may lock in place via the indent 223 and protrusion 227 when the adjusting member 202 slides into the channel 226 of the lower left member 200.

Referring to FIG. 9, the lower left member 200 and the adjusting member 202 may be locked in place via an anti-contraction lock 217. In one aspect, the adjusting member 202 may comprise the anti-contraction lock 217 and the lower left member 200 may comprise a plurality of grooves 221. The anti-contraction lock 217 may fit into one of the plurality of grooves 221*a* as to lock the lower left member 200 and the adjusting member 202 in place. In one aspect, the anti-contraction lock 217 may be coupled to a resistance member 216, such as a spring. The anti-contraction lock 217 may be tapered such that movement of the adjusting member 202 within the lower left member 200 is allowed. The movement is allowed when enough pressure is applied laterally such that the tapered surface of the anti-contraction lock 217 presses down on the resistance member 216, which allows the anti-contraction lock 217 to disengage the groove 221*a* of the lower left member 200. In one aspect, the anti-contraction lock 217 is tapered only on one side such that movement of the adjusting member 202 is only possible in the direction away from the lower left member 200. In a further aspect, the anti-contraction lock 217 may protrude the groove 221*a*, which can allow a user to press the anti-contraction lock 217, thereby disengaging the anti-contraction lock 217 from the groove 221*a* In another aspect, the lower right member 201 may comprise the plurality of grooves 221*a* such that the lower right member 201 locks with the adjusting member 202 via the anti-contraction lock 217.

Figure 10:
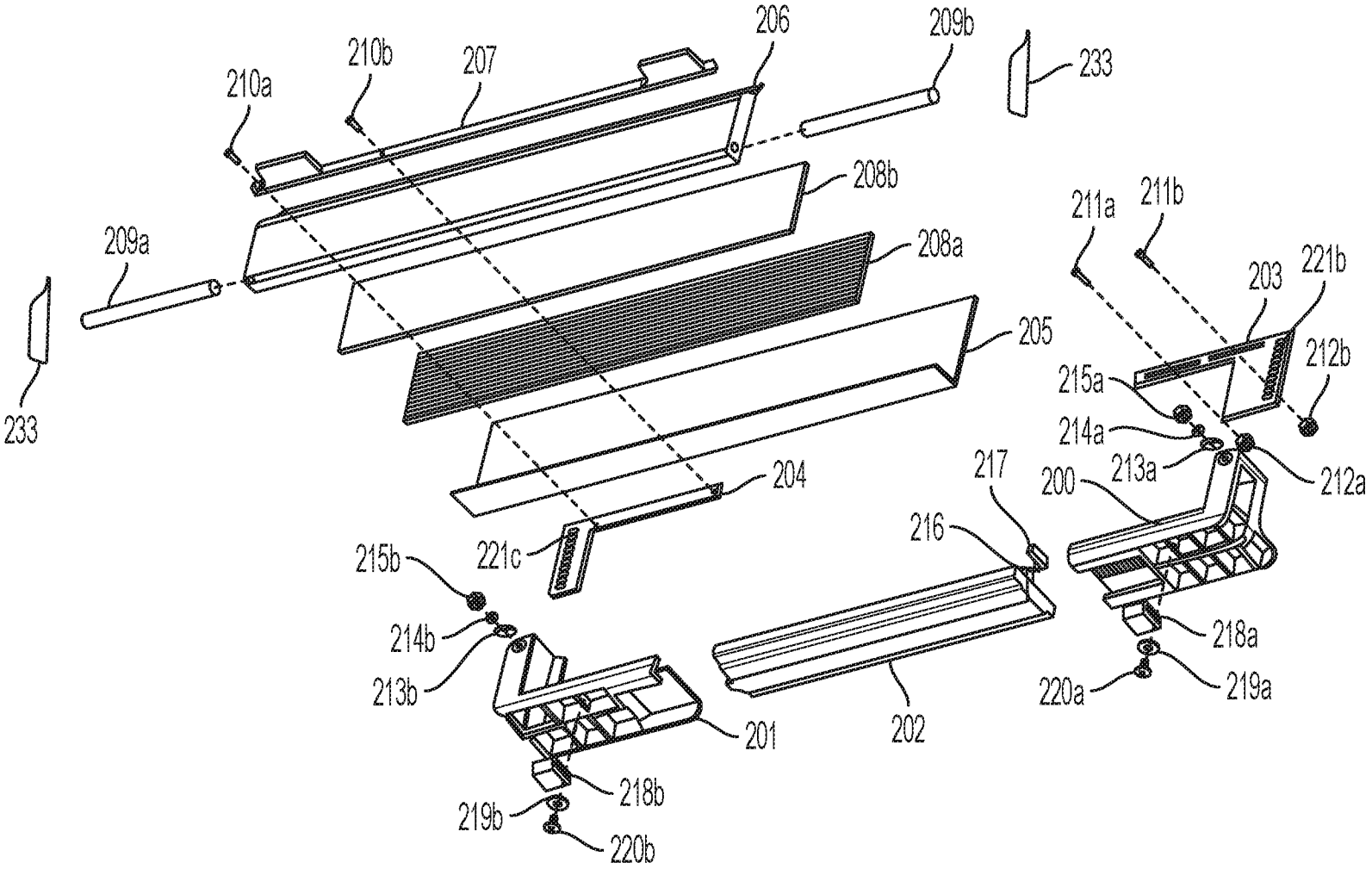
FIG. 10 is an exploded view of the back perspective view of the adjustable mail slot insert of FIG. 1.
Figure 17:
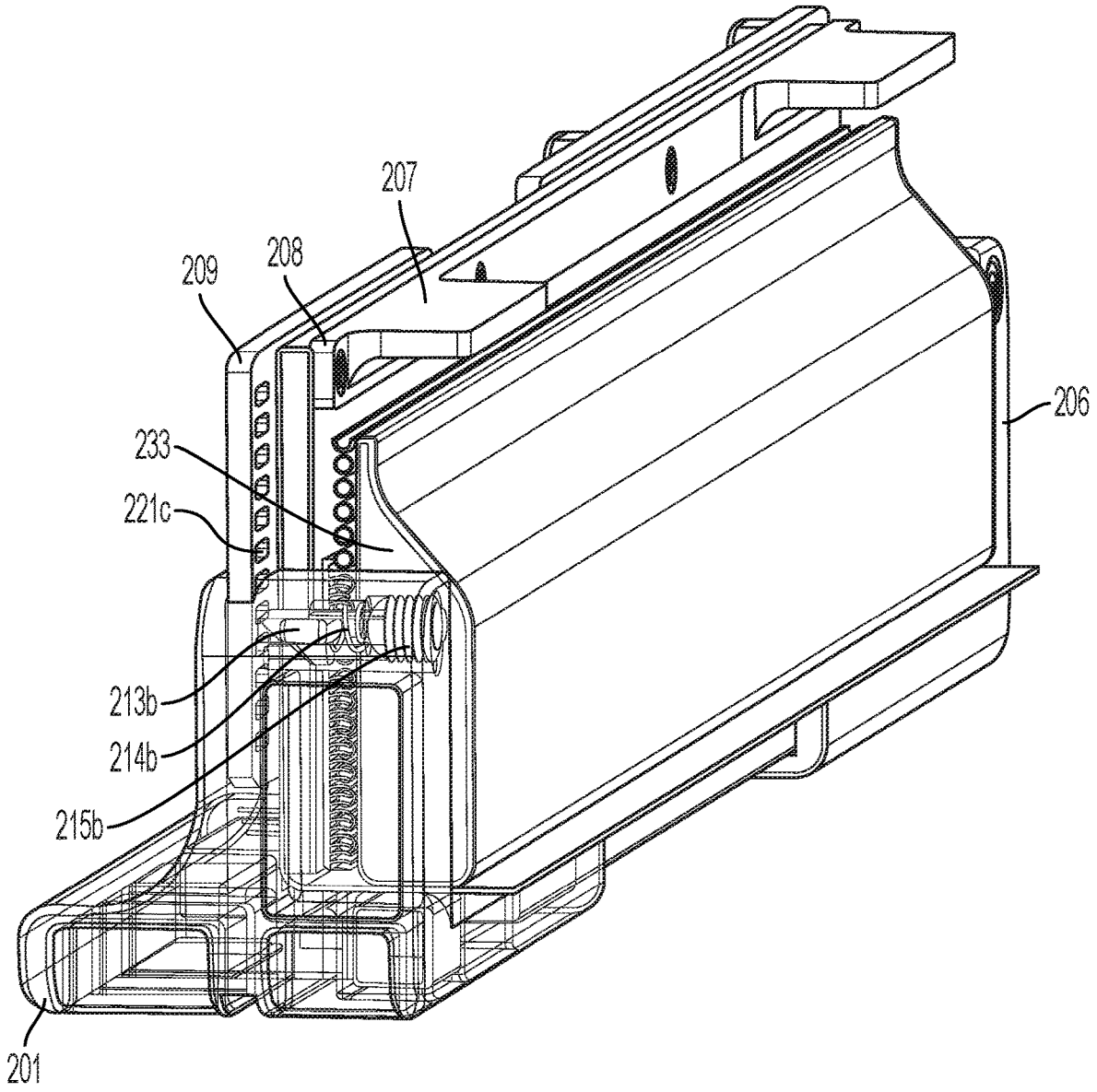
FIG. 17 is a side perspective view of the adjustable mail slot of FIG. 1 according to a non-limiting embodiment.

With reference to FIG. 10, the lower left member 200 and the upper left member 203 may be locked together with an anti-contraction lock 213*a*, and similarly the lower right member 201 and upper right member 204 with the anti-contraction lock 213*b*. The upper left and right members 203 and 204 may comprise a plurality of grooves 221*b*, 221*c*. With reference to the left side, the lower left member 200 may comprise the anti-contraction lock 213*a*. The anti-contraction lock may be coupled to a resistance member 214*a*. The anti-contraction lock 213*a* may fit into one of the plurality of grooves 221*b* of the upper left member 203. In one aspect, the anti-contraction lock 213*a* may be tapered only on one side such that the movement of the upper left side 203 is allowed. The movement is allowed when enough pressure is applied vertically such that the tapered surface of the anti-contraction lock 213*a* presses down on the resistance member 214*a*, which allows the anti-contraction lock 213*a* to disengage the groove 221*b* of the upper left member 203. In one aspect, the anti-contraction lock 213*a* is only tapered on one side such that movement of the upper left member 203 is only possible in the direction away from the lower left member 200. In a further aspect, the anti-contraction lock 213*a* may be secured to the lower left member 200 with a lock retainer 215*a*. Any locking mechanism may be used as the lock retainer 215, for example, a screw and nut may be used. With reference to FIG. 17, the anti-contraction lock 213*b*, the resistance member 214*b*, and the lock retainer 215*b* similarly functions to lock within a groove 221*c* and allow movement between the upper right member 204 and the lower right member 201.

Figure 11:
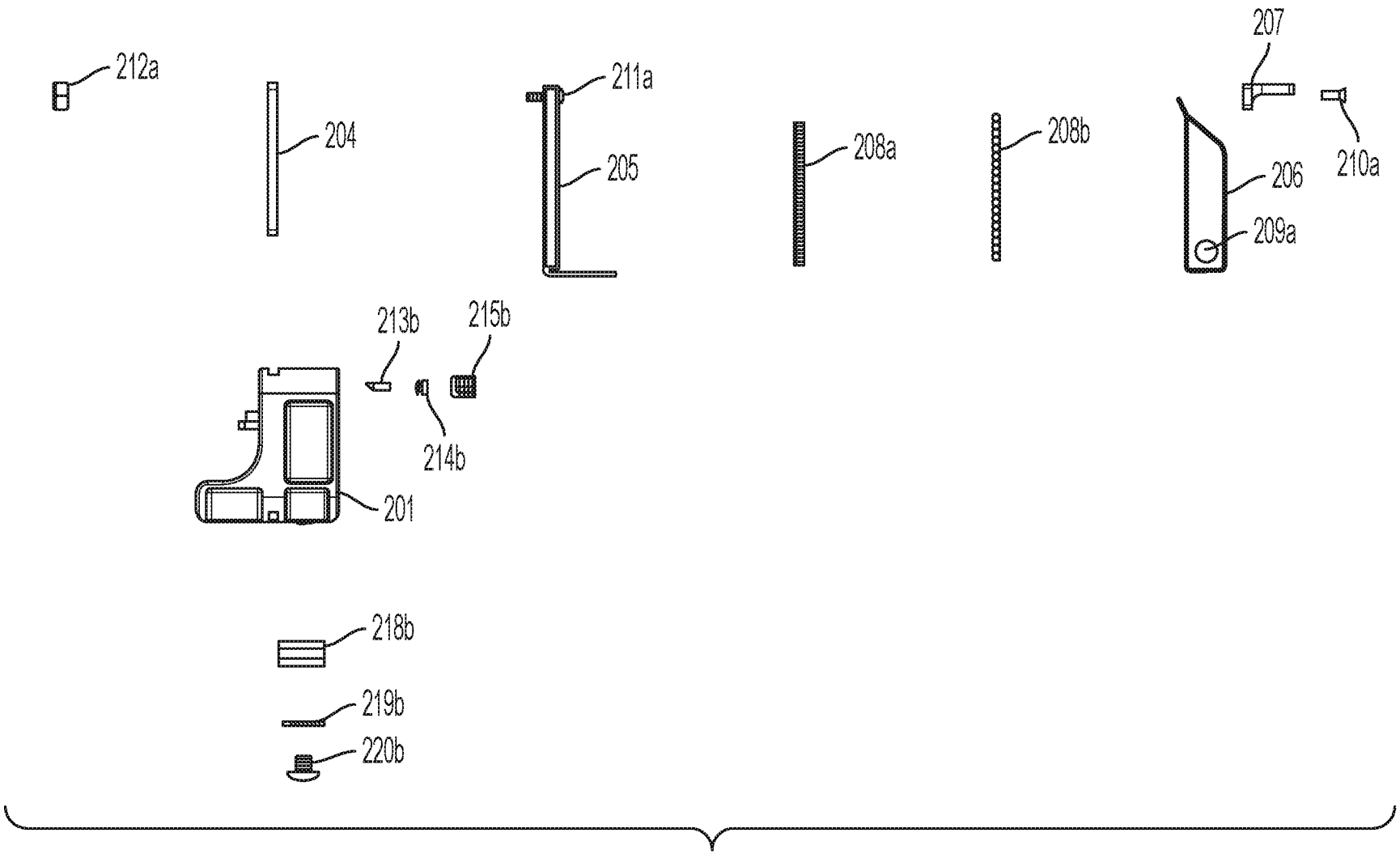
FIG. 11 is an exploded view of the side view of the adjustable mail slot insert of FIG. 1.

With reference to FIGS. 9-11, the insert 1 may comprise a flap 205. The flap 205 may be deformable such that pressure on the flap 205 will deform the flap 205. The flap 205 may be, for example, made of deformable foam material that resists deformation and tends to return to its original position. In a further non-limiting embodiment, the flap 205 may be coated with a material that gives the flap 205 resistive qualities for returning to its original shape. The flap 205 may also have an abrasion resistant coating. These coatings protect the insert 1 from varying weather conditions, such as cyclical heating/cooling in a very wide temperature range, wide ranges of ambient humidity levels, direct dirt, dust, and/or debris exposure, and direct rain, mist, and/or snow moisture exposure. The materials selected and the coatings will provide excellent durability in any environment to allow the insert 1 to function for an exceptionally long period of time.

Figure 12:
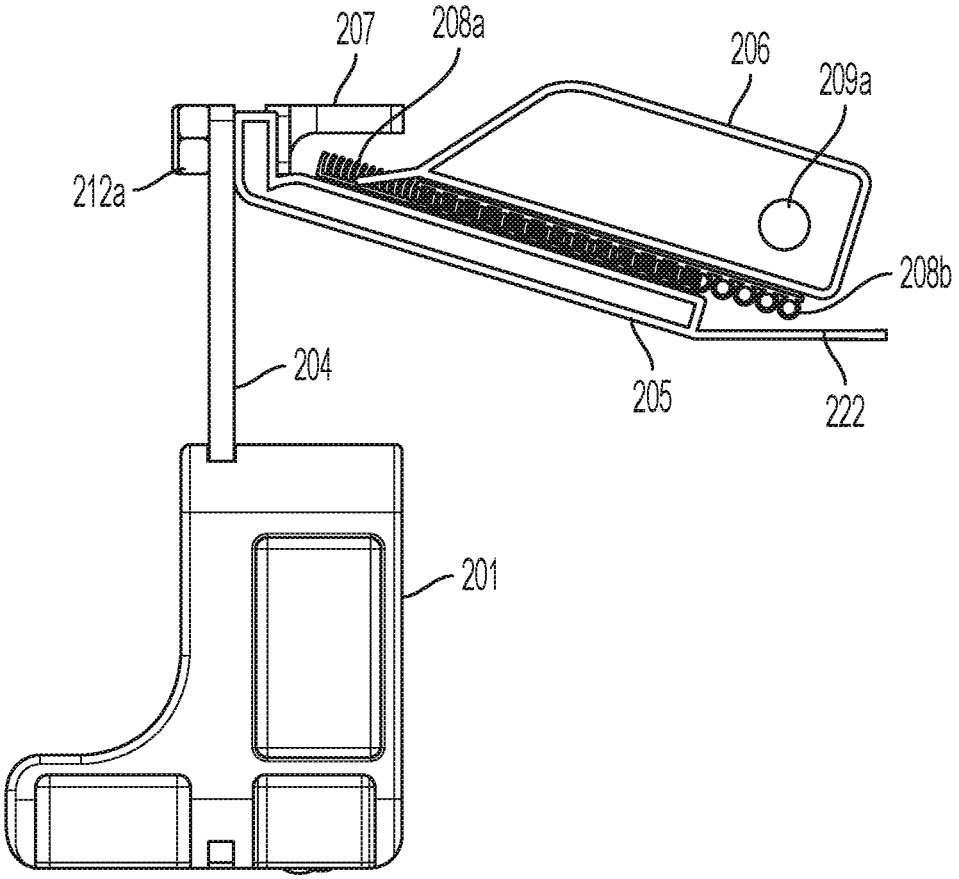
FIG. 12 is a side view of the adjustable mail slot insert of FIG. 1 in use position.

With reference to FIG. 12, a deformed flap 205 in its use position is shown. The flap 205 may further comprise a back weight 206. The back weight aids the flap 205 in returning to its original position by utilizing the gravitational forces from the use position. The back weight 206 may further comprise rods 209 to further aid the flap 205 return to its original position from a deformed position. The flap 205 may further comprise insulating members 208*a*, 208*b*. The insulating members 208*a*, 208*b* of the insert 1 protects the indoor against cold or hot air, odors, small particles, or similar objects from entering the building via the insert 1. In one aspect the flap 205 may further comprise a flap extension 222, which further helps close any air gaps between the insert 1 and the flap 205. In a further aspect, the flap 205 may comprise caps 233. With reference to FIG. 17, the caps 233 may cover the side surfaces of the flap 205, which may further comprise the insulating members 208*a*, 208*b*, back weight 206, and/or rods 209, such that the caps 233 create an air pocket on the side of the flap 205. The air pocket serves as an extra insulation measure to protect the indoors from the cold or heat of the outside.

With further reference to FIGS. 9-11, the upper right member 204 and the flap 205 may comprise apertures 229. In one aspect, the apertures are aligned, as shown by dotted lines in FIGS. 9 and 10, such that the locking mechanisms 210*a*, 210*b* may secure the flap 205 to the upper right member 204. In a non-limiting aspect, the locking mechanisms 210*a*, 210*b* may be screws that secure the flap 205 to the upper right member 204 via the apertures 229. In a further aspect, the upper left member 203 may comprise the apertures 209, such that the flap 205 may be secured to the upper right member 203.

With reference to FIGS. 9-11, the upper left member 203 may comprise elongated apertures 230. The apertures 231 of the flap 205 may be aligned with the elongated apertures 230, such that a locking mechanism can secure the upper left member 203 and the flap 205 together. In a non-limiting aspect, the locking mechanism can comprise screw 211*a*, 211*b* and bolt 212*a*, 212*b*. Such locking mechanism allows lateral movement of the upper left member 203 with respect to the flap 205 while still secured to the flap 205. In a further aspect, the upper right member 204 may comprise the elongated apertures 230 such that the upper right member 204 is slidably secured to the flap 205.

With reference to FIGS. 9-11, the insert 1 may further comprise magnets 218*a*, 218*b*. The magnets 218*a*, 218*b* may be secured to the lower left member 200 and the lower right member 201 respectively. The magnets may be secured in any known conventional manner. In a non-limiting aspect, the magnets are secured to the lower members with screws 220*a*, 220*b* and washers 219*a*, 219*b*. The magnets 218*a*, 218*b* may interact with the rods 209*a*, 209*b* of the flap 205. The magnetic interaction between the magnets 218*a*, 218*b* and the rods 209*a*, 209*b* further aids the flap 205 return to its original position from its deformed position, thereby eliminating any air gaps between the flap 205 and the insert 1.

Figure 4:
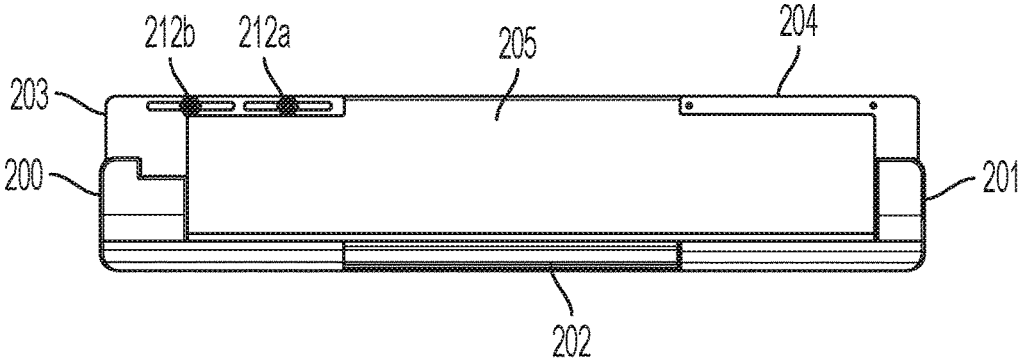
FIG. 4 is a front view of the adjustable mail slot insert of FIG. 1.
Figure 5:
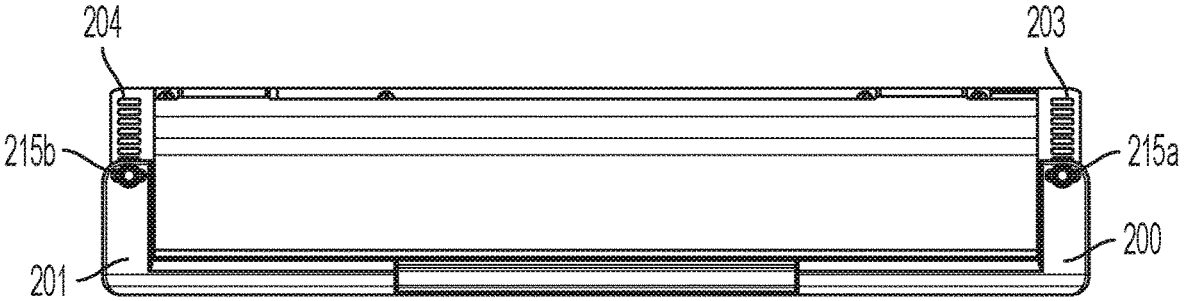
FIG. 5 is a back view of the adjustable mail slot insert of FIG. 1.
Figure 6:
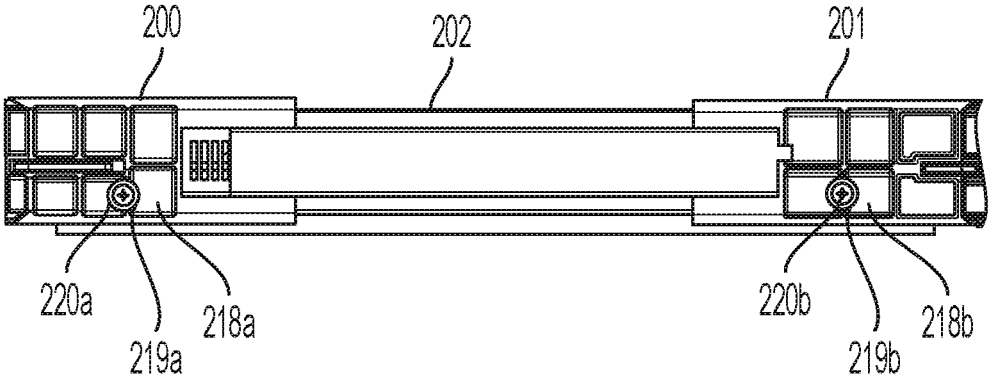
FIG. 6 is a bottom view of the adjustable mail slot insert of FIG. 1.
Figure 7:
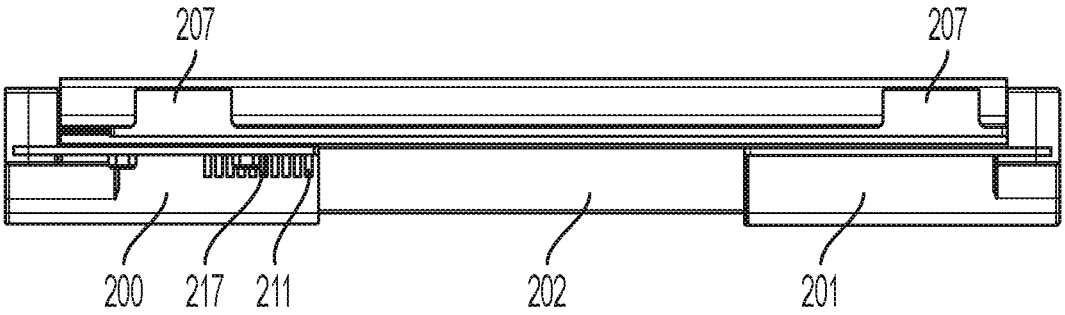
FIG. 7 is a top view of the adjustable mail slot insert of FIG. 1.

With reference to FIGS. 4-7, an assembled insert 1, according to a non-limiting aspect, is shown. FIG. 4 shows the secured upper left member 203 and the flap 205 secured via the locking mechanism 212*a*, 212*b*. FIG. 5 shows the upper left member 203 and the lower left member 200 secured via the anti-contraction lock 213*a*, which is secured by the lock retainer 215*a*. Similarly, the upper right member 204 and the lower right member 201 are secured via the anti-contraction lock 213*b*, which is secured by the lock retainer 215*b*. FIG. 6 shows the magnets 218*a*, 218*b* secured to the respective lower members. FIG. 7 shows the anti-contraction lock 217 of the adjusting member 202 protruding through one of the plurality of grooves 221*a*, thereby securing the adjusting member 202 to the lower left member 200. Though not shown in FIG. 6, the lower right member 201 and the adjusting member are secured via the interaction between the indent 223 and aperture 229.

Figure 13:
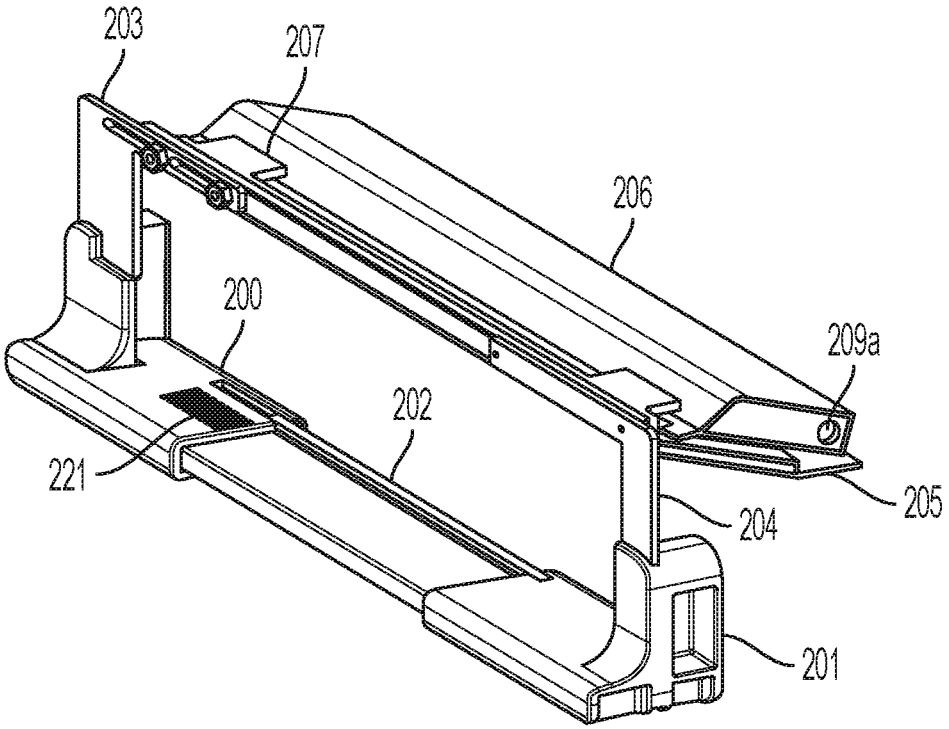
FIG. 13 is a front perspective view of the adjustable mail slot insert of FIG. 1 in use position.
Figure 14:
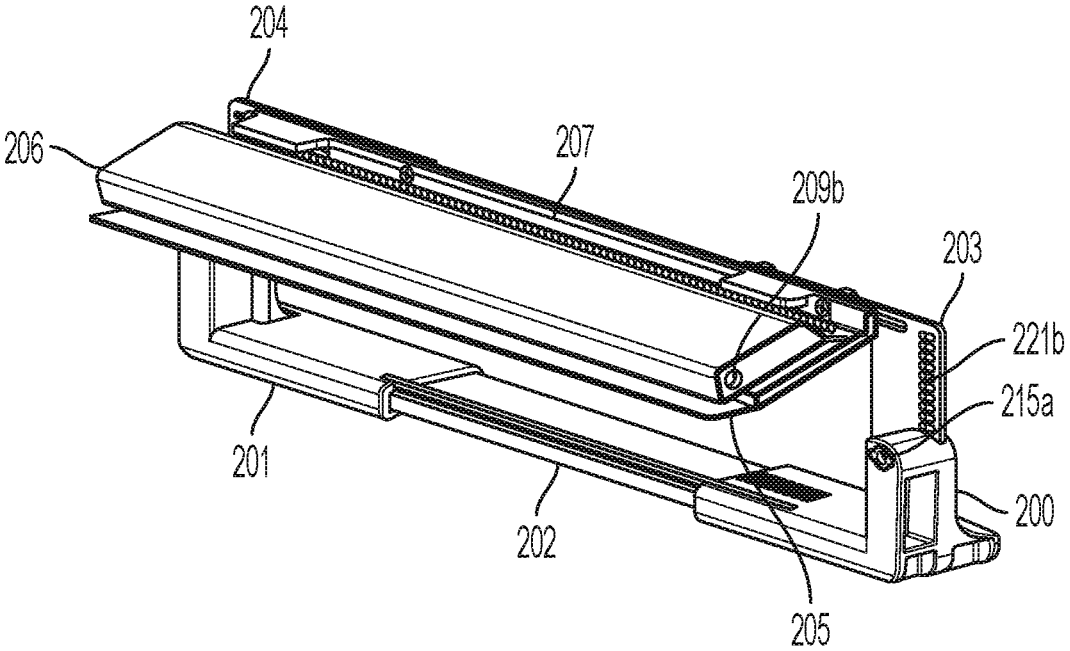
FIG. 14 is a back perspective view of the adjustable mail slot insert of FIG. 1 in use position.
Figure 15:
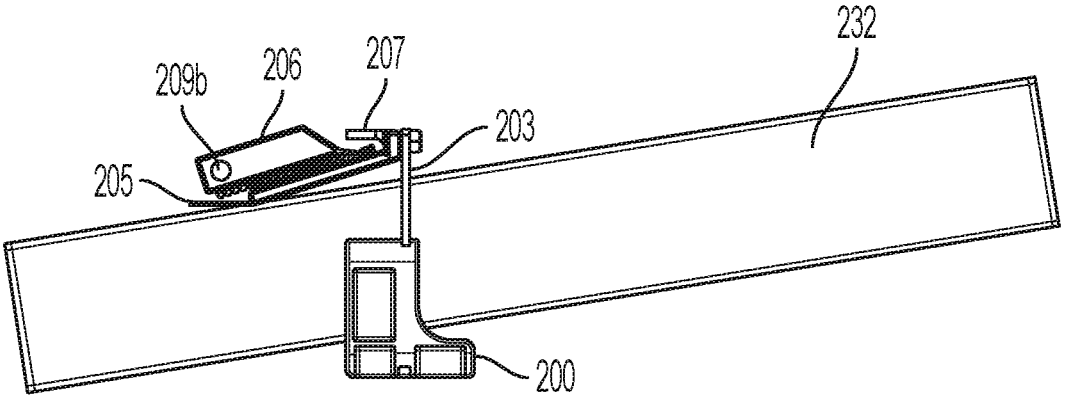
FIG. 15 is a side view of the adjustable mail slot insert of FIG. 1 in use position.
Figure 16:
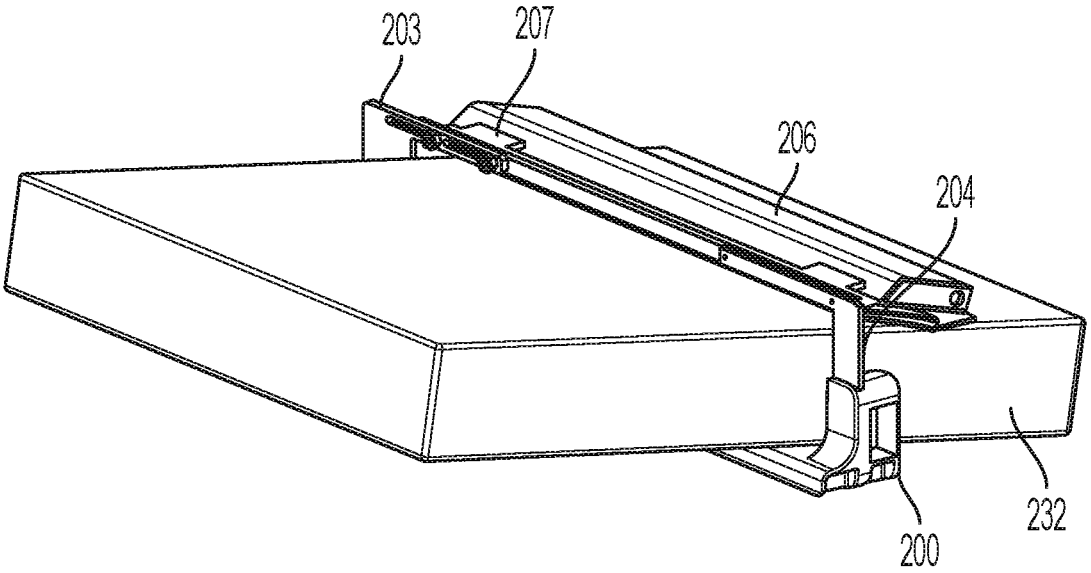
FIG. 16 is a front perspective view of the adjustable mail slot insert of FIG. 1 in use position.

With reference to FIGS. 12-14, an aspect of the insert 1 in its use position is demonstrated. In these figures the flap 205 is deformed. The deformed flap 205 creates an opening. As shown in FIGS. 15 and 16, a package 232 may access the opening. When a package 232 is pushed onto the flap 205 from the outside, the flap 205 deforms and bends. When the opening is no longer obstructed by a package 232, the flap 205 resumes its original position, thereby closing the opening. The back weight 206 and the rods 209*a*, 209*b* may help the flap 205 resume its original position. In a further aspect, the rods 209*a*, 209*b* may interact with magnets 218*a*, 218*b* to further close any air gaps between the flap 205 and the insert 1.

A method of using the insert 1 is not described with reference to FIGS. 1-7. The insert 1 is configured for use in any type of door, wall, or window, regardless of the dimensions of the mail slot (not shown) that is defined in the door, wall, or window. The insert 1 may be adjusted to fit the size of the mail slot defined in the door, wall, or window. During use of the insert 1, the insert 1 is configured to be adjustable in a vertical and/or horizontal direction so that the height and width of the insert 1 may be adjusted to the height and width of the mail slot. After the insert 1 has been provided in the mail slot, an individual may move the lower members 200 and 201 by exerting lateral force or by pressing on the anti-contraction lock 217. Such force allows one-way expansion of the insert 1 in a horizontal direction to adjust to the width of the mail slot. Similarly, force can be exerted vertically on the insert 1, thereby allowing one-way expansion of the insert 1 in a vertical direction to adjust to the height of the mail slot. The adjusted height of the lower left member 200 and upper left member 203 may differ with the adjusted height of the lower right member 201 and the upper right member 204. The height on the left and the right side may differ, for example, due to the irregular shape of the mail slot. In such cases, the assembled insert 1 may not have a substantially rectangular cross-section. Once the insert 1 is expanded to adjust to fit the mail slot, the four members and the external friction member 207 presses out onto the mail insert and holds the insert 1 in place via friction. The pressure is maintained by the anti-contraction locks 213*a*, 213*b*, 217 that are held in place by their respective resistance members 214*a*, 214*b*, 216. Additionally, a foam lining may be provided in the mail slot around the insert 1 before installing the insert 1 in order to increase insulation and friction between the mail slot and the insert 1.

While various aspects of the adjustable mail slot insert are provided in the foregoing description, those skilled in the art may make modifications and alterations to these aspects without departing from the scope and sprit of the invention. For example, it is to be understood that this disclosure contemplates that, to the extent possible, one or more features of any aspect can be combined with one or more features of any of other aspect. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. An adjustable mail slot insert, comprising:

two upper members, each upper member having a side leg and a top leg;

two lower members, each lower member having a side leg and a bottom leg; and a flap, wherein the flap is connected to the two upper members, wherein one upper member is operatively connected to one lower member and the other upper member is operatively connected to the other lower member, wherein the flap is made of a resistant deformable foam material, wherein the insert is adjustable in a horizontal direction and a vertical direction through movement of the upper and lower members relative to one another, and wherein the upper members and the lower members define an opening, wherein the resistant deformable foam material of the flap covers the opening when the flap is in a closed position.

2. The adjustable mail slot insert of claim 1, further comprising an adjusting member, wherein the adjusting member is received within channels of the two lower members.

3. The adjustable mail slot insert of claim 2, wherein the adjusting member further comprises an anti-contraction lock and a resistance member, wherein the resistance member allows the anti-contraction lock to protrude from a groove of the plurality of grooves of one of the two lower members.

4. The adjustable mail slot insert of claim 3, wherein the anti-contraction lock is tapered.

5. The adjustable mail slot insert of claim 1, wherein the flap further comprises insulating members and a back weight.

6. The adjustable mail slot insert of claim 1, wherein the flap further comprises metal rods.

7. The adjustable mail slot insert of claim 1, wherein the flap further comprises at least one cap, wherein the cap covers a side surface of the flap, wherein the cap creates an air pocket between the cap and the flap.

8. The adjustable mail slot insert of claim 1, wherein the flap further comprises an extension flap.

9. The adjustable mail slot insert of claim 1, wherein the lower members further comprise magnets.

10. The adjustable mail slot insert of claim 1, wherein the upper members further comprise a plurality of grooves and the lower members further comprise anti-contraction locks and resistance members, and wherein the resistance members allow each anti-contraction lock to protrude from a groove of the plurality of grooves of the respective upper member.

11. The adjustable mail slot insert of claim 10, wherein the anti-contraction locks are tapered.

12. The adjustable mail slot insert of claim 1, wherein the upper members and the lower members are substantially L-shaped.

13. A method of adjusting a mail slot insert, comprising the steps of:

a) providing an adjustable mail slot insert comprising: two upper members; two lower members; a flap made of a resistant deformable foam material; and an adjusting member, wherein the upper members and the lower members define an opening, wherein the resistant deformable foam material of the flap covers the opening when the flap is in a closed position; and, either b) moving the lower members and the adjusting member relative to one another to adjust the width of the insert; or c) moving the lower members and the upper members relative to one another to adjust the height of the insert.

14. An adjustable mail slot insert comprising:

two left members, each left member having a first leg and a second leg;

two right members, each right member having a third leg and a fourth leg; and at least one anti-contraction lock and at least one resistance member, wherein the at least one anti-contraction lock and the at least one resistance member lock one of the following in place: the two left members or the two right members, wherein one of the two left members or one of the two right members further comprises a plurality of grooves and the other left member or the other right member is configured to receive the at least one anti-contraction lock and the at least one resistance member, and wherein the at least one anti-contraction lock is tapered and resisted by the at least one resistance member, wherein the at least one anti-contraction lock is configured to fit into a groove of the plurality of grooves, and wherein the at least one anti-contraction lock is pushed into the groove by the at least one resistance member.

15. The adjustable mail slot insert of claim 14, wherein the at least one anti-contraction lock limits the movement of the left members and right members in one direction.

16. The adjustable mail slot insert of claim 14, further comprising an adjusting member, the adjusting member having an additional anti-contraction lock and an additional resistance member, the adjusting member configured to be received by one of the two left members and one of the two right members, wherein one of the one of the two left members and one of the two right members further comprises a plurality of grooves.

17. The adjustable mail slot insert of claim 16, wherein the additional anti-contraction lock is tapered and resisted by the additional resistance member, wherein the additional anti-contraction lock is configured to fit into a groove of the plurality of grooves, and wherein the additional anti-contraction lock is pushed into the groove by the additional resistance member.

* * * * *